US005156131A

United States Patent [19]

Kisaichi

[11] Patent Number: 5,156,131

[45] Date of Patent: Oct. 20, 1992

[54] FUEL CONTROL APPARATUS FOR AN ENGINE

[75] Inventor: Hiroyasu Kisaichi, Himeji, Japan

[73] Assignee: Mitsubishi Denki K.K., Tokyo, Japan

[21] Appl. No.: 721,010

[22] Filed: Jun. 26, 1991

[30] Foreign Application Priority Data

Jun. 27, 1990 [JP] Japan ..... 2-171913

[51] Int. Cl.[5] ..... F02D 41/18

[52] U.S. Cl. ..... 123/492; 123/493

[58] Field of Search ..... 123/492, 493

[56] References Cited

U.S. PATENT DOCUMENTS 4,257,377 3/1981 Kinugawa et al. ..... 123/492

4,630,206 12/1986 Amano et al. ..... 123/492

4,721,087 1/1988 Kanno et al. ..... 123/488

*Primary Examiner*—Andrew M. Dolinar

*Attorney, Agent, or Firm*—Sughrue, Mion, Zinn, Macpeak & Seas

[57] ABSTRACT

A fuel control apparatus for an engine which comprises means for measuring an air quantity sucked to the engine and means for supplying fuel to the engine in correspondence with the air quantity sucked to the engine, said means for measuring the air quantity sucked to the engine, measuring n times in one stroke of the engine, said means for supplying fuel to the engine, supplying fuel to the engine of which quantity is based on a ratio of change of the measured value of the air quantity.

2 Claims, 3 Drawing Sheets

One stroke of engine
TA
TB

Crank angle signal

AFS signal

Throttle butterfly opening

PA
PB
P

TA
TB
T

FUEL CONTROL APPARATUS FOR AN ENGINE

BACKGROUND OF THE INVENTION

1. Field of the Invention

The present invention relates to a fuel control apparatus for an engine capable of supplying fuel corresponding to a quantity of air by suction the engine to arrive at an appropriate air/fuel rate.

2. Discussion of Background

The conventional fuel control device of an engine measures an air quantity sucked in one stroke of the engine, as a whole, and supplies fuel to the engine, the quantity of which is in correspondence with the measured suction air quantity.

Since the above mentioned conventional fuel control apparatus for an engine, measures the air quantity sucked in one stroke of the engine, as a whole, when the engine is accelerating or decelerating and the suction air quantity is changing rapidly, considerable time is required to detect the change of the suction air quantity, and as the result, the responsiveness of the control device is poor.

SUMMARY OF THE INVENTION

It is an object of the present invention to provide a fuel control apparatus for an engine capable of supplying fuel in accordance with the suction air quantity of the engine. According to an aspect of the present invention, there is provided a fuel control apparatus for an engine which comprises means for measuring an air quantity sucked into the engine and means for supplying fuel into the engine in correspondence with the air quantity sucked to the engine, said means for measuring the air quantity sucked into the engine measuring a predetermined number of times in one stroke of the engine, and said means for supplying fuel to the engine, supplying a quantity of fuel based on a ratio of the change of the measured value of the air quantity.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
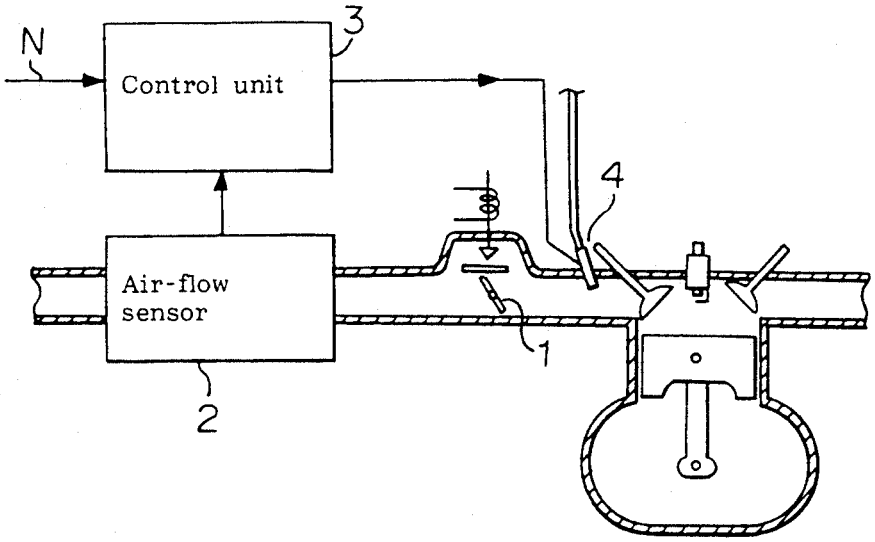
FIG. 1 is a construction diagram showing an embodiment of a system to which a fuel control apparatus of an engine is applied, according to the present invention.

Referring to the drawings, explanation will be given on the present invention.

FIG. 1 is a construction diagram showing an embodiment of a system to which a fuel control apparatus of an engine is applied, according to the present invention. In FIG. 1, a numeral 1 signifies a throttle butterfly valve which changes the suction air quantity of an engine, 2, a Karman-type air-flow sensor (hereinafter AFS) which generates pulse signal corresponding to the suction air quantity, 3, a control unit which calculates and controls a drive time of an electromagnetic valve, mentioned later, by a crank angle signal and AFS 2, mentioned later, 4, electromagnetic valve, and the notation N signifies a crank angle signal.

Figure 2:
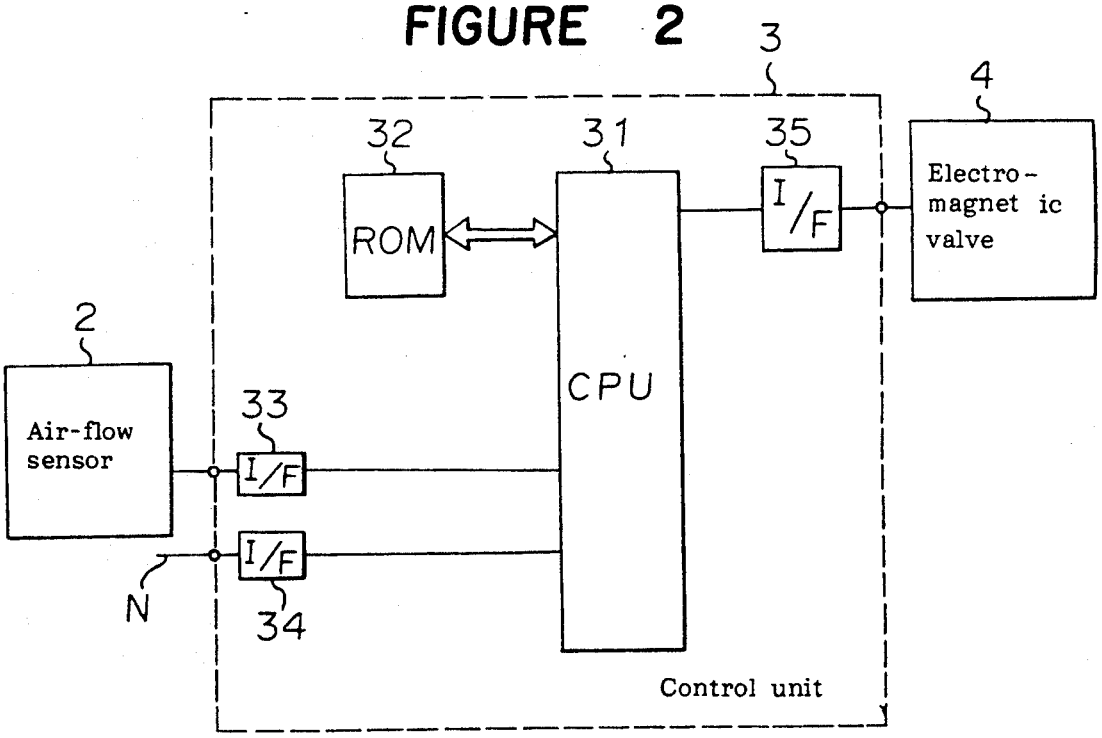
FIG. 2 is a block diagram of this apparatus.

FIG. 2 is a block diagram of the control unit 3. In FIG. 2, a numeral 31 signifies a CPU, 32, a ROM, and 33 to 35, I/F which put interface between the various parts and the CPU 31.

Figures 3A, 3B, 3C, 3D, 3E:
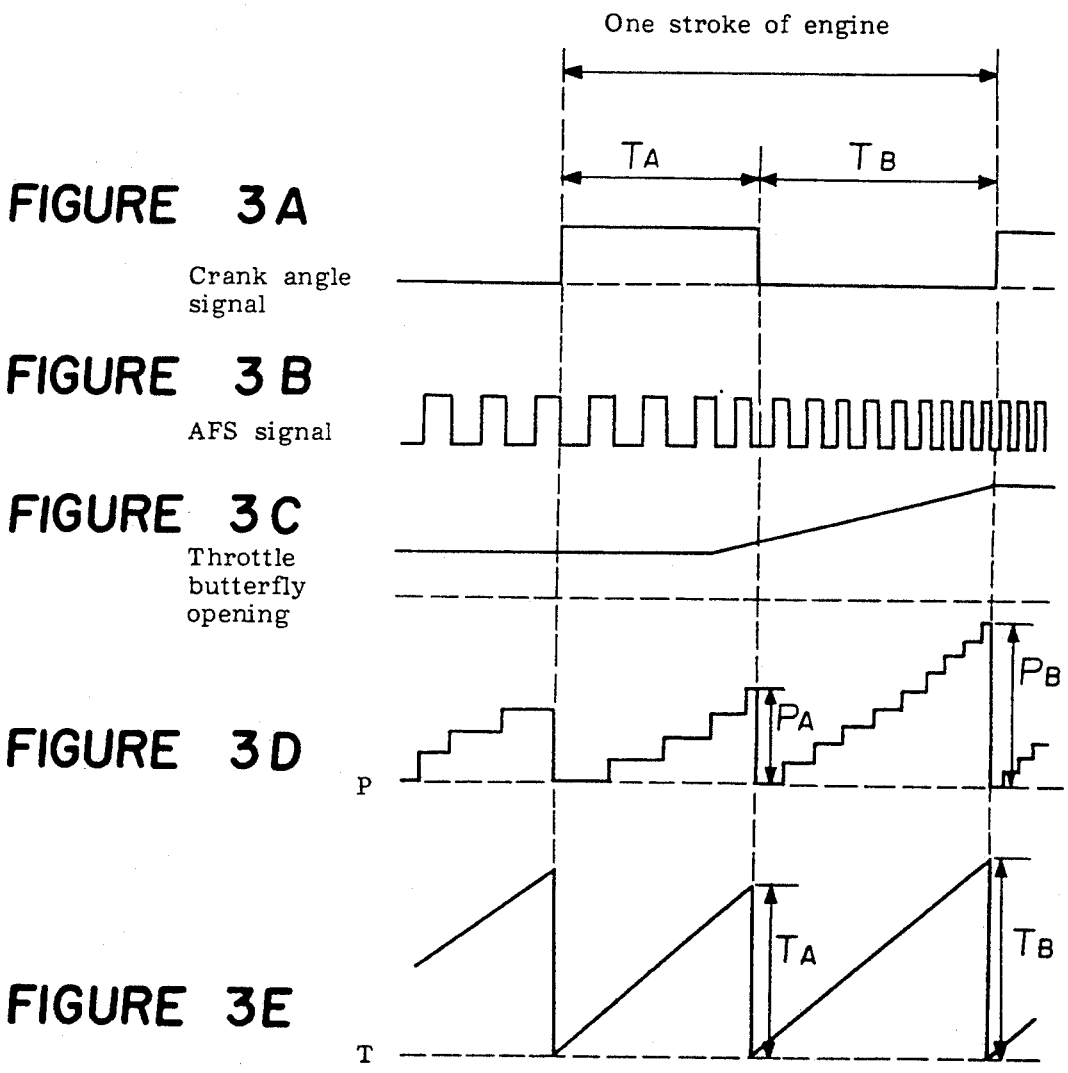
FIGS. 3A to 3E are timing charts of this apparatus.

FIGS. 3A to 3E are timing charts of the abovementioned various signals in one stroke of the engine 1. As shown in FIG. 3C, when the opening of the throttle butterfly valve 1 changes and the suction air quantity increases, as shown in FIG. 3B, AFS 2 generates pulse signals having frequency number which is proportional to the suction air quantity. When the suction air quantity is small, a frequency number of the output pulse of AFS 2 is low. When the suction air quantity is large, the frequency number of the output pulse becomes high. On the other hand, the crank angle signal N, as shown in FIG. 3A, is a signal generated in mesh with the one stroke of the engine. One cycle of the crank angle signal N corresponds to one stroke of the engine. FIG. 3D shows the output pulse number P of AFS2. FIG. 3E shows a time between edges of the crank angle signal, $T_A$ and $T_B$, of AFS2.

Figure 4:
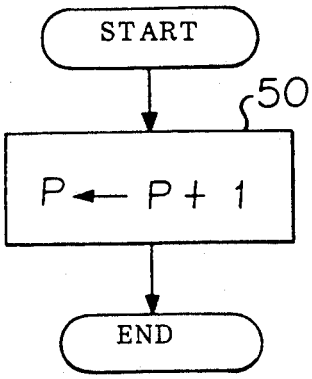
FIG. 4 to 6 are a flow charts which explain the operation of the apparatus.
Figure 5:
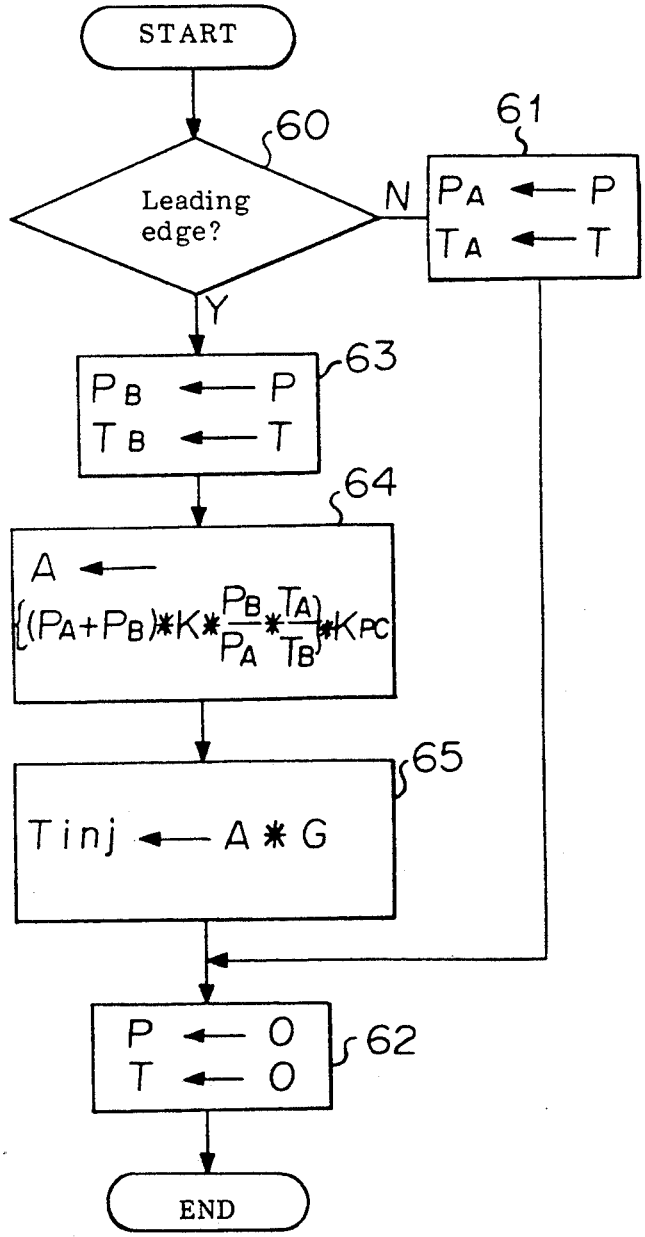

Next, explanation will be given to the operation of the control unit 3 in the above embodiment, based on the flow charts of FIGS. 4 to 6. First of all, explanation will be given to the flow chart in FIG. 4. The program based on the flow charts is performed upon the trailing edge of the output pulse of AFS2. In Step 50, after the output pulse signal of AFS2 arrives, at the point of the tailing edge, $P \leftarrow P+1$, that is, the output pulse number P of AFS2 is counted, and the operation is finished.

Figure 6:
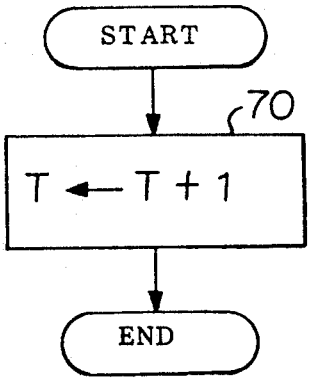

The program based on the flow chart in FIG. 6 is performed at every predetermined time. At every predetermined time, in Step 70, the operation of $T \leftarrow T+1$, is performed. This time T is utilized to measure the time between edges of a crank angle signal, $T_A$ and $T_B$, mentioned later.

Next, explanation will be given to the flow chart in FIG. 5. The program based on this flow chart is performed at every leading edge and every tailing edge of the crank angle signal N.

First of all, in Step 60, a judgment is made on whether this program is performed by the leading edge of the crank angle signal. When a judgment is made in which the program is initiated by the tailing edge, in Step 60, the judgment is N. In Step 61, the output pulse number P of AFS2 is replaced with $P_A$, the output time T of AFS2 is replaced with $T_A$, and these two values are memorized in a memory. The operation goes to Step 62, in which the output pulse number and the output time T of AFS2 are cleared, and the operation is finished. Accordingly, the time required from the leading edge to the tailing edge of the crank angle signal is $T_A$, a pulse number outputted from AFS2 during time $T_A$, is $P_A$.

When a judgment is made in which this program is initiated by the rise of the crank angle signal, in Step 60, the judgment is Y. The operation goes to Step 63, where the output pulse number P of AFS2 and the times are memorized in the memory as $P_B$ and $T_B$, respectively. In this case, the time between the tailing edge and the leading edge of the crank angle signal is $T_B$, and the pulse number outputted by AFS2 in the time $T_B$, is $P_B$.

Next, in Step 64, the suction air quantity A in one stroke of the engine is calculated by following equation.

$$A \leftarrow \{(P_A+P_B) * K * ((P_B * T_A)/(P_A * T_B)\} * K_{PC}$$

where K is a reflecting constant of an excessive information $(P_B * T_A)/(P_A * T_B)$, and $K_{PC}$ is a conversion constant for converting the output pulse number of AFS2, to the suction air quantity.

In Step 65, the drive time $T_{inj}$ of the electromagnetic valve 4, is calculated by the following equation.

$$T_{ing} \leftarrow A * G$$

where G is a constant for converting the suction air quantity A to a drive time of the electromagnetic valve 4.

As stated above, the drive time $T_{inj}$ of the electromagnetic valve 4 is calculated, in Step 62, the values of the output pulse number P of AFS2, and the time T are cleared, and the operation is finished.

As explained above, the ratio of change $(P_B * T_A)/(P_A * T_B)$ of the suction air quantity during the time between the leading edge and the tailing edge (during $T_A$) of the crank angle signal, and the suction air quantity during the time between the tailing edge and the leading edge (during $T_B$) of the crank angle signal, is reflected to the suction air quantity A in one stroke of the engine. This ratio of change is also reflected to the quantity of fuel.

Furthermore, in this embodiment, explanation is given to the case in which the engine is accelerating and the suction quantity of the air is increasing. However, the same effect is obtained in the case in which the engine is decelerating and the suction air quantity is decreasing, by performing the same treatment as in the accelerating case.

As mentioned before, in this invention, the suction air quantity is measured by "n" time of the one stroke of the engine, and the ratio of change of the suction air quantity is reflected to the fuel quantity which is supplied to the engine. Therefore, the fuel control apparatus of an engine with high responsiveness, is composed accurately and economically.

Obviously, numerous modifications and variations of the present invention are possible in light of the above teachings. It is therefore to be understood that within the scope of the appended claims, the invention may be practiced otherwise than as specifically described herein.

What is claimed is:

1. A fuel control apparatus for an engine which comprises:

means for measuring an air quantity sucked to the engine; and means for supplying fuel to the engine in correspondence with the air quantity sucked to the engine;

said means for measuring the air quantity sucked to the engine, measuring a plurality of times in one stroke of the engine to obtain at least first and second values of air quantity;

said means for supplying fuel to the engine, supplying fuel to the engine of which quantity is based on the ratio of said first and second values of the air quantity.

2. A fuel control apparatus for an engine, comprising:

means for measuring a crank angle signal having a single pulse cycle during each engine stroke, said crank angle signal having a leading edge and a trailing edge for each stroke of said engine;

means for measuring a first air flow quantity between the leading and trailing edges of the crank angle signal during each stroke of said engine;

means for measuring a second air flow quantity between the trailing edge of said crank angle signal and the leading edge of said signal during a successive stroke of said engine;

means for measuring a rate of change in said first and second air flow quantities; and means for supplying fuel to the engine based on said rate of change.

* * * * *